US005165536A

United States Patent [19]

Boivin

[11] Patent Number: 5,165,536

[45] Date of Patent: Nov. 24, 1992

[54] PACKAGING FOR WATCH STRAPS

[75] Inventor: Daniel J. Boivin, Franois, France

[73] Assignee: Cobra, Bescancon, France

[21] Appl. No.: 723,327

[22] Filed: Jun. 28, 1991

[30] Foreign Application Priority Data

Jun. 29, 1990 [FR] France ..... 90 08207
Aug. 29, 1990 [FR] France ..... 90 5436

[51] Int. Cl.[5] ..... B65D 85/40

[52] U.S. Cl. ..... 206/301; 206/45.15; 206/45.34; 220/4.23

[58] Field of Search ..... 206/301, 45.14, 45.15, 206/45.34, 525; 220/4.22, 4.23, 336

[56] References Cited

U.S. PATENT DOCUMENTS

| | | | |
|---|---|---|---|
| 2,388,442 | 11/1945 | Reyburn | 220/4.22 X |
| 2,547,991 | 4/1951 | Witbrod | 206/301 |
| 2,649,956 | 8/1953 | Knibb | 206/45.34 X |
| 3,044,605 | 7/1963 | Clement | 206/45.34 |
| 3,135,456 | 6/1964 | Palazzolo | 220/4.22 X |
| 3,365,056 | 1/1968 | Mandel | 206/301 X |
| 3,371,772 | 3/1968 | Fontannaz | 206/45.14 |
| 3,645,419 | 2/1972 | Shorrock | 220/4.22 X |
| 3,648,831 | 3/1972 | Arnone | 206/45.14 |
| 3,918,577 | 11/1975 | Horzick | 206/45.34 |
| 4,905,857 | 3/1990 | Her | 220/4.22 |

FOREIGN PATENT DOCUMENTS

| | | | |
|---|---|---|---|
| 1165311 | 10/1958 | France | 206/301 |
| 1497756 | 10/1967 | France . | |
| 2044907 | 2/1971 | France . | |
| 2333463 | 7/1977 | France | 206/45.14 |
| 7623 | of 1884 | United Kingdom | 220/336 |

*Primary Examiner*—Bryon P. Gehman
*Attorney, Agent, or Firm*—Sandler, Greenblum & Bernstein

[57] ABSTRACT

Packaging, especially for watch straps, having two arms for maintaining a strap, such that the two arms may pivot with respect to each other into a plane containing an end of each of the two arms, and associated with the journal axis is an opening whose cross-section is substantially equal to that of a conventional watch case. Each arm can have a U-shaped cross-section, and the arms are arranged such that when they extend one against the other, the assembly forms a closed case. Also, each arm can include an element for maintaining a corresponding end of the strap.

20 Claims, 2 Drawing Sheets

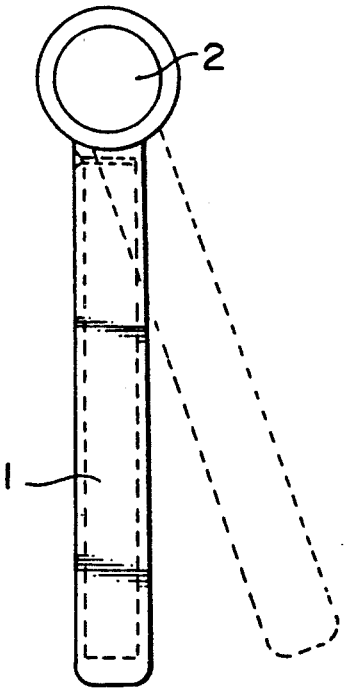
Fig- 6
Fig- 7
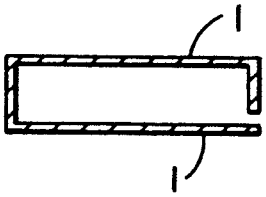
Fig- 8
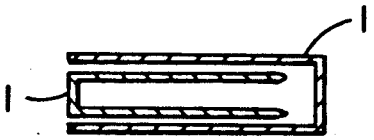

PACKAGING FOR WATCH STRAPS

CROSS-REFERENCE TO RELATED APPLICATIONS

This application is related to U.S. Design application Ser. Nos. 07/661,625 and 07/661,626, filed on Feb. 27, 1991, which are expressly incorporated by reference in their entirety

BACKGROUND OF THE INVENTION

1. Field of the Invention

The present invention concerns packaging to display objects, and is especially adapted to enclose watch straps.

2. Discussion of Background and Material Information

Generally, straps, such as watch straps, are enclosed in partially transparent packaging that includes means for hooking the packaging onto a bracket of a display unit.

The two ends of the strap are superposed, or placed end to end in the packaging, and it is therefore very difficult for the buyer, to know how the strap will look when it is assembled on a watch case. Accordingly, conventional display packages for straps have the disadvantage that the consumer will not be readily able to visually ascertain the aesthetic appeal of the packaged straps.

SUMMARY OF THE INVENTION

The packaging that is the object of the present invention, and that overcomes the disadvantages associated with conventional packaging for straps is remarkable by the fact that the packaging includes two arm portions, in each of which a corresponding end of the strap is maintained. The two arms portions are pivotable with respect to each other around a journal axis associated with the ends of the two arm portions to permit pivoting of the two arms from a closed position, wherein the two arms are adjacent each other to form a closed package, to an open position, wherein the arm portions and the journal axis are substantially aligned in a plane. Moreover, associated with the journal axis is an opening whose cross-section is substantially equal to that of a conventional watch case.

In particular, the present invention is directed to packaging for watch straps including two arms, in each of which arm one portion of a strap is capable of being stored. The two arms are pivotable about a journal axis with respect to each other into a plane containing an end of each of the two arms, and associated with the journal axis is an opening whose cross-section is substantially equal to that of a conventional watch case.

Each of the two arms can comprise a U-shaped cross-section, and the two arms may be arranged to form a closed package when the two arms extend against each other. Moreover, each of the two arms can include means for maintaining a corresponding end of the watch strap, and the package may include a ring having a shouldered sleeve and a retaining edge for pivotally connecting the two arms to each other.

The two arms can include at least one scallop, and may further include means for maintaining the two arms against each other.

Further, and in another manner of describing the invention the packaging includes two arms for containing a strap in a lengthwise orientation; the two arms are connected at and are pivotable around a journal axis; and an opening is associated with the journal axis which has a cross-section substantially equal to that of a conventional watch case.

Each of the two arms comprises a U-shaped cross-section, and the two arms are arranged to form a closed package when the two arms extend against each other. The U-shaped cross-sections can be of substantially the same dimensions, whereby when the two arms extend against each other upper-most leg portions of the U-shaped cross sections are adjacent each other. In such an embodiment, the two arms include means for maintaining a corresponding end of a watch strap. Alternatively, the U-shaped cross-sections are of different dimensions, whereby when the two arms extend against each other a smaller U-shaped cross-section extends into a larger U-shaped cross-section to form a case. In this embodiment, the smaller U-shaped cross-section includes means for maintaining a corresponding end of a watch strap.

In another embodiment, the two arms have L-shaped cross-sections, and the two arms are pivotable to a closed position wherein the two arms overlap to form a case. Again, the case, as with all embodiments, contains means for maintaining a corresponding end of a watch strap.

As with all embodiments, the journal axis can comprise a ring having a shouldered sleeve and a retaining edge for pivotally connecting the two arms to each other, at least one of the two arms can include at least one scallop, the packaging can include means for maintaining the two arms against each other, and the material of construction of the packaging can be at least partially transparent, and most preferably substantially entirely transparent.

BRIEF DESCRIPTION OF THE DRAWINGS

The present invention will be better understood in light of the description that follows, along with the annexed drawings, that are non-limiting, and in which:

FIG. 6 is an elevational view illustrating another embodiment adapted for single end straps;

FIG. 7 is a sectional view, on a larger scale, taken along the arms shown in FIG. 6 in a closed position with the arms overlapping; and FIG. 8 is a sectional view similar to FIG. 7, illustrating a variation of the embodiment.

DETAILED DESCRIPTION OF THE PREFERRED EMBODIMENTS

With reference to the.drawings, the packaging consists of two hollow arms 1, journalled one on top of another at one of their ends so as to form an opening 2. The section of the opening 2 is designed to be substantially equal to that of a conventional watch case.

Figure 2:
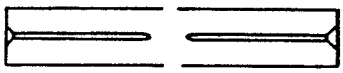
FIG. 2 a sectional view, on a larger scale, taken along line II—II of FIG. 1, and limited to the section.
Figure 3:
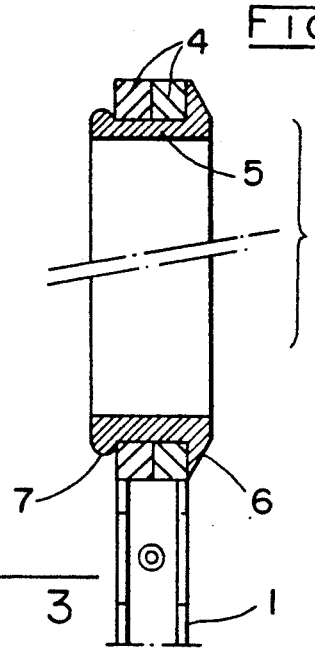
FIG. 3 is a sectional view, on a larger scale, along line III—III of FIG. 1, and limited to its upper portion.

As can be seen from FIG. 2, each arm 1 has a U-shaped cross-section, that forms a groove in which the corresponding portion B of the strap is inserted.

Figure 1:
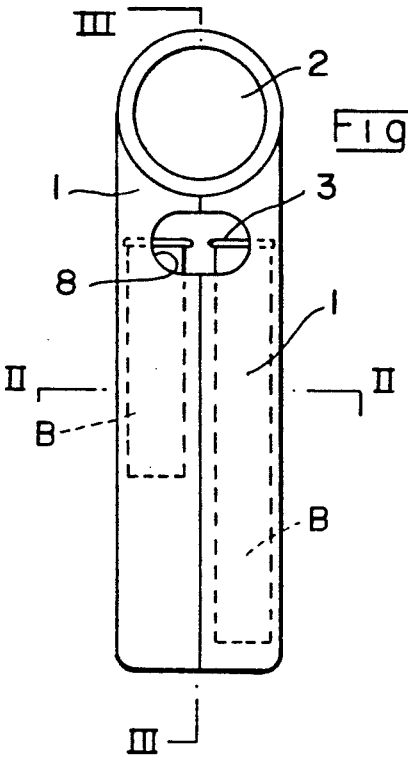
FIG. 1 is an elevational view of packaging according to the invention.

The arms are arranged in such a manner that when they are rotated against each other, as illustrated in FIG. 1, the assembly forms a closed case.

Means are provided in each of the arms 1 so as to maintain at least one end of a strap. To this end, each arm 1 has an bump or protruding arm 3 on which an B of the strap is placed.

According to one embodiment, each arm 1 is affixed by one of its ends, to a ring 4, and the assembly is ensured by a sleeve 5 having a shoulder 6 and a retaining edge 7. The sleeve 5 and retaining edge 7 are capable of passing through the two rings. The central portion of the sleeve 5 forms the above-discussed opening 2.

The packaging is at least partially transparent, and preferably is composed entirely of a transparent material. Moreover, at least one of the two arms may include at least one scallop 8, enabling the buyer to see and to judge the nature of the material used to make the strap.

Figure 4:
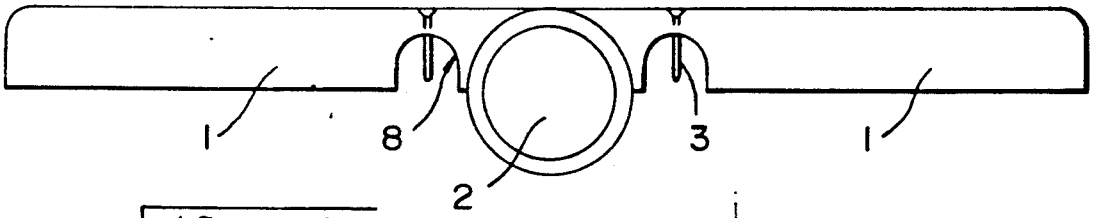
FIG. 4 is an elevational view similar of the packaging as illustrated in FIG. 1 showing the packaging in an open position.

In the open position illustrated in FIG. 4, the buyer has the possibility of putting the strap, while still in the case, above his watch, whereby the watch case appears in the opening 2. In this manner, the buyer may judge the effect of the watch case with the strap in what may be considered to be equivalent to an assembled state, even when the strap is still in the display package.

The opening 2 can advantageously be used to hook the packaging on a bracket of the display unit, if so desired.

Figure 5:
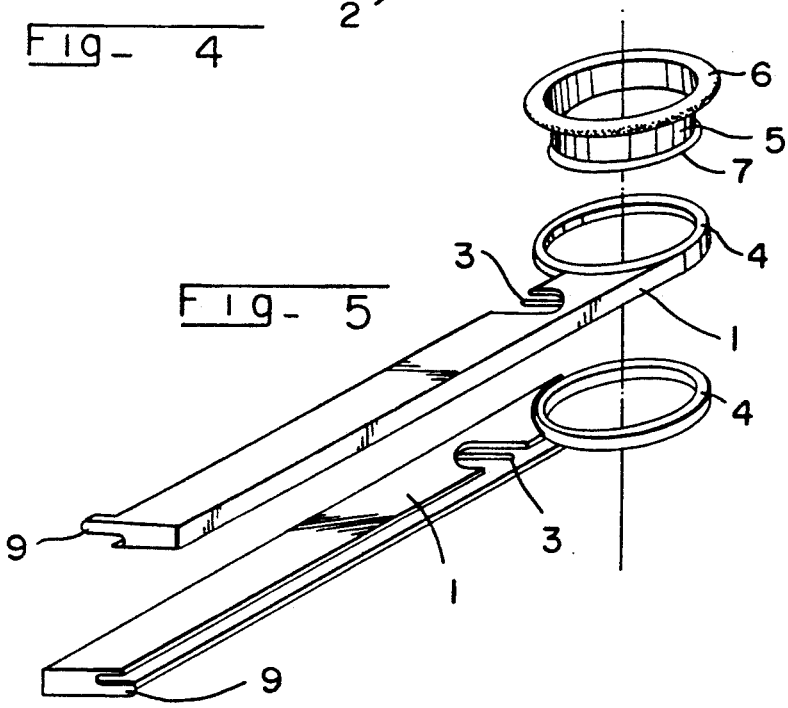
FIG. 5 is a partial perspective view of the packaging.

Means can be provided to maintain the two arms against each other in the closed position, such as lugs 9 that grip each other, as illustrated in FIG. 5.

The above-described packaging may be adapted to receive a strap composed of a single element, such as a metallic strap. In this case, each arm may have an L-shaped cross-section, as is shown in FIG. 7, wherein the arms may overlap each other. Additionally, each arm may have a U-shaped cross-section, as is shown in FIG. 8, wherein one of the arms can be embedded into the other. In this situation, the dimensions of one of the U-shaped arms would be larger than the other U-shaped arm.

What is claimed is:

1. Packaging for watch straps, comprising two arms, each of said two arms having structure capable of storing one portion of a strap; said two arms being pivotable about a member forming a journal axis with respect to each other into a plane containing an end of each of said two arms; and an opening positioned within said member forming a journal axis and having a cross-section dimensioned to allow viewing of a watch case therethrough.

2. The packaging according to claim 1, wherein each of said two arms comprises a U-shaped cross-section, and said two arms are arranged to form a closed package when said two arms extend against each other.

3. The packaging according to claim 2, further including means for maintaining said two arms against each other.

4. The packaging according to claim 1, wherein each of said two arms includes means for maintaining a corresponding end of a watch strap.

5. The packaging according to claim 1, wherein each of said two arms includes at least one scallop.

6. Packaging for watch straps, comprising two arms, each of said two arms having structure capable of storing one portion of a strap; said two arms being pivotable about a member forming a journal axis with respect to each other into a plane containing an end of each of said two arms; and an opening positioned within said member forming a journal axis and having a cross-section dimensioned to allow viewing of a watch case therethrough, said member forming a journal axis and said opening comprising a ring having a shouldered sleeve and a retaining edge for pivotally connecting said two arms to each other.

7. Packaging comprising two arms each having structure for containing a strap in a lengthwise orientation; said two arms being connected at and being pivotable around a member forming a journal axis; and an opening positioned within said member forming a journal axis and having a cross-section dimensioned to allow viewing of a watch case therethrough.

8. The packaging according to claim 7, wherein each of said two arms comprises a U-shaped cross-section, and said two arms are arranged to form a closed package when said two arms extend against each other.

9. The packaging according to claim 8, wherein said U-shaped cross-sections are of substantially the same dimensions, whereby when said two arms extend against each other, portions of said U-shaped cross-sections are adjacent each other.

10. The packaging according to claim 9, wherein each of said two arms includes means for maintaining a corresponding end of a watch strap.

11. The packaging according to claim 8, wherein said U-shaped cross-sections are of different dimensions, whereby when said two arms extend against each other a smaller U-shaped cross-section extends into a larger U-shaped cross-section to form a case.

12. The packaging according to claim 8, wherein each of said smaller U-shaped cross-section and said larger U-shaped cross-section includes means for maintaining a corresponding end of a watch strap.

13. The packaging according to claim 8, wherein each of said two arms includes at least one scallop.

14. The packaging according to claim 7, wherein each of said two arms has an L-shaped cross-section, and said two arms are pivotable to a closed position wherein said two arms overlap to form a case.

15. The packaging according to claim 14, further including means for maintaining a corresponding end of a watch strap.

16. The packaging according to claim 7, wherein each of said two arms includes at least one scallop.

17. The packaging according to claim 7, further including means for maintaining said two arms against each other.

18. The packaging according to claim 7, wherein the material of construction of the packaging is at least partially transparent.

19. The packaging according to claim 18, wherein at least one of said two arms includes at least one scallop.

20. Packaging comprising two arms each having structure for containing a strap in a lengthwise orientation; said two arms being connected at and being pivotable around a member forming a journal axis; and an opening positioned within said member forming a journal axis end having a cross-section dimensioned to allow viewing of a watch case therethrough, and said member forming a journal axis and said opening comprising a ring having a shouldered sleeve and a retaining edge for pivotally connecting said two arms to each other.

* * * * *